US005167170A

United States Patent [19]

Croteau

[11] Patent Number: 5,167,170

[45] Date of Patent: Dec. 1, 1992

[54] ICE SKATE SUPPORT SHARPENING APPARATUS

[76] Inventor: Dale A. Croteau, Faro, Yukon, Canada, Y0B 1K0

[21] Appl. No.: 745,355

[22] Filed: Aug. 15, 1991

[51] Int. Cl.[5] ..... A63C 3/10; A63C 3/12

[52] U.S. Cl. ..... 76/83; 206/315.1; 294/146; 280/814; 224/917

[58] Field of Search ..... 76/83; 280/825, 809, 280/814, 811, 815, 816; 294/146, 147, 163, 165; 206/315.1; 224/917

[56] References Cited

U.S. PATENT DOCUMENTS

| | | | |
|---|---|---|---|
| 1,930,810 | 10/1933 | Johnson | 280/825 |
| 2,353,809 | 7/1944 | Carson | 280/814 |
| 2,672,263 | 3/1954 | Alber | 206/315.1 |
| 3,749,232 | 7/1973 | Craig | 280/814 |
| 4,021,054 | 5/1977 | Csutor | 280/825 |
| 4,301,898 | 11/1981 | Plough et al. | 206/315.1 |
| 4,392,674 | 7/1983 | Evon | 280/825 |
| 4,546,999 | 10/1985 | Lehr | 280/825 |
| 4,673,196 | 6/1987 | Hall | 280/814 |
| 4,746,159 | 5/1988 | Webb et al. | 280/814 |

FOREIGN PATENT DOCUMENTS 0002888 of 1896 United Kingdom ..... 206/315.1

*Primary Examiner*—Roscoe V. Parker
*Attorney, Agent, or Firm*—Leon Gilden

[57] ABSTRACT

A bag member includes a central cavity, with the central cavity including a right and left cavity flap removably mounted to a first side wall of the bag exposing an ice skate receiving cavity. Each ice skate receiving cavity includes an ice skate support member, wherein the ice skate support member includes a "V" shaped groove for receiving an ice skate blade, with the "V" shaped groove including a sharpening stone positioned at an entrance of the groove to effect sharpening, as well as support, of the ice skate when positioned within the bag structure. A modification of the invention includes fluid reservoirs directing a lubricant fluid into the groove and associated ice skate blade to retard corrosion and promote longevity of the ice skate blade. Further, an indicator is utilized for illustrating proper positioning of each ice skate within each "V" shaped groove.

6 Claims, 5 Drawing Sheets

ICE SKATE SUPPORT SHARPENING APPARATUS

BACKGROUND OF THE INVENTION

1. Field of the Invention

The field of invention relates to ice skate support apparatus, and more particularly pertains to a new and improved ice skate support and sharpening apparatus wherein the same is arranged for the simultaneous sharpening and support of ice skates for ease of transport thereof.

2. Description of the Prior Art

Ice skate blades, to maintain their effectiveness, must be maintained in a sharpened and protected manner prior to and subsequent their use. Prior art devices have been utilized in this regard and are exemplified in U.S. Pat. No. 1,930,810 to Johnson wherein a guard member includes a flexible pad-like member securable to a lower edge of the ice skate blade.

U.S. Pat. No. 4,021,054 to Csutor sets forth an ice skate blade supoprt apparatus wherein a rigid housing member mounts an ice skate blade thereon, wherein an ice skate is supported upon a padded surface of the structure.

U.S Pat. No. 4,546,999 to Lehr sets forth a skate guard, wherein a flexible bag-like member is securable about an ice skate blade.

U.S. Pat. No. 4,392,674 to Evon sets forth a scabbard wherein a plurality of intercommunicating and telescopingly securable members receive an ice skate blade therebetween.

U.S. Pat. No. 4,676,196 to Hall sets forth a guard for ice skates, wherein a flexible housing includes a groove, including fins within the groove to maintain the ice skate blade within the groove.

As such, it may be appreciated that there continues to be a need for a new and improved ice skate support and sharpening apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of ice skate blade protection apparatus now present in the prior art, the present invention provides an ice skate support and sharpening apparatus wherein the same is arranged for the securement and simultaneous sharpening of ice skate blades within a bag structure and for transport and storage of the ice skate members. As such, the general purpose of the present invention, which will be described subsequently in greater detail, is to provide a new and improved ice skate support and sharpening apparatus which has all the advantages of the prior art ice skate blade support apparatus and none of the disadvantages.

To attain this, the present invention provides a bag member including a central cavity, with the central cavity including a right and left cavity flap removably mounted to a first side wall of the bag exposing an ice skate receiving cavity. Each ice skate receiving cavity includes an ice skate support member, wherein the ice skate support member includes a "V" shaped groove for receiving an ice skate blade, with the "V" shaped groove including a sharpening stone positioned at an entrance of the groove to effect sharpening, as well as support, of the ice skate when positioned within the bag structure. A modification of the invention includes fluid reservoirs directing a lubricant fluid into the groove and associated ice skate blade to retard corrosion and promote longevity of the ice skate blade. Further, indicator means are utilized for illustrating proper positioning of each ice skate within each "V" shaped groove.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, aditional features of the invention that will be described hereinafter and which will form the subject manner of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ice skate support and sharpening apparatus which has all the advantages of the prior art ice skate support apparatus and none of the disadvantages.

It is another object of the present invention to provide a new and improved ice skate support and sharpening apparatus which may be easily and efficiently manufactured and marketed.

It is a further object of the present invention to provide a new and improved ice skate support and sharpening apparatus which is of a durable and reliable construction.

An even further object of the present invention is to provide a new and improved ice skate support and sharpening apparatus which is susceptible of a low cost of manufacture with regard to both materials and labor, and which accordingly is then susceptible of low prices of sale to the consuming public, thereby making such ice skate support and sharpening apparatus economically available to the buying public.

Still yet another object of the present invention is to provide a new and improved ice skate support and sharpening apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
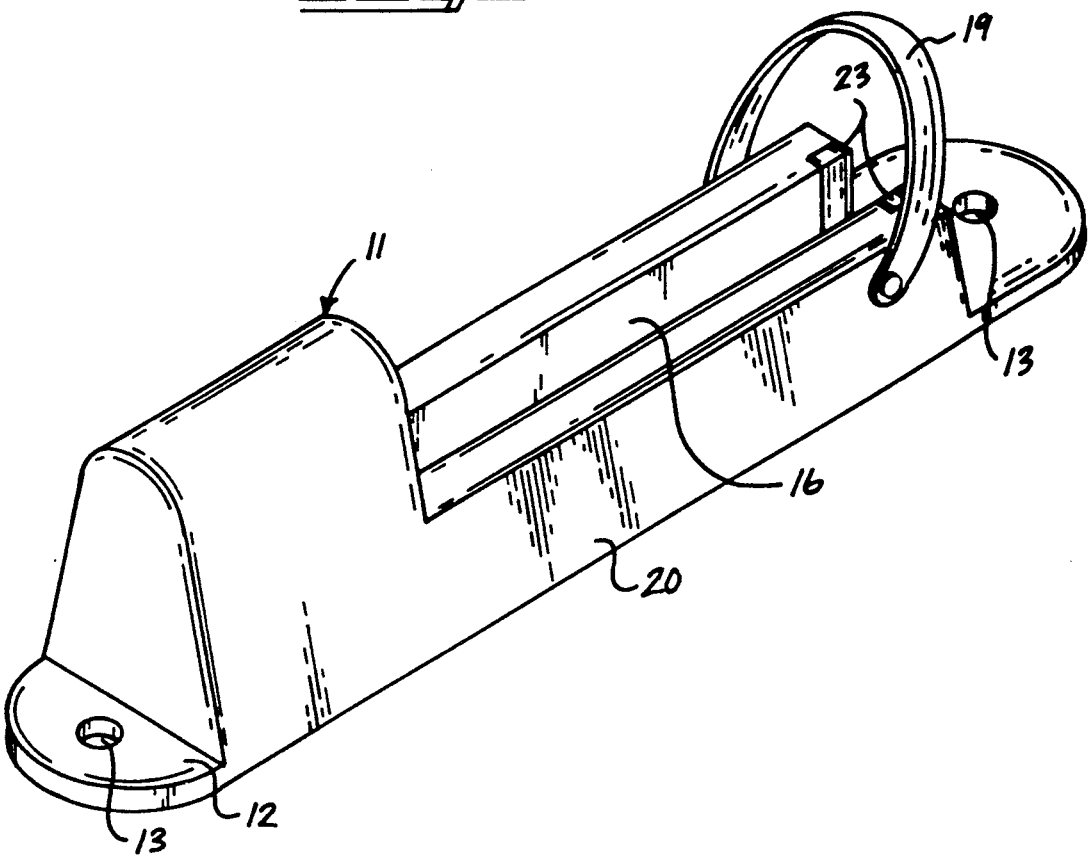
FIG. 1 is an isometric illustration of the skate support member utilized by the instant invention.
Figure 2:
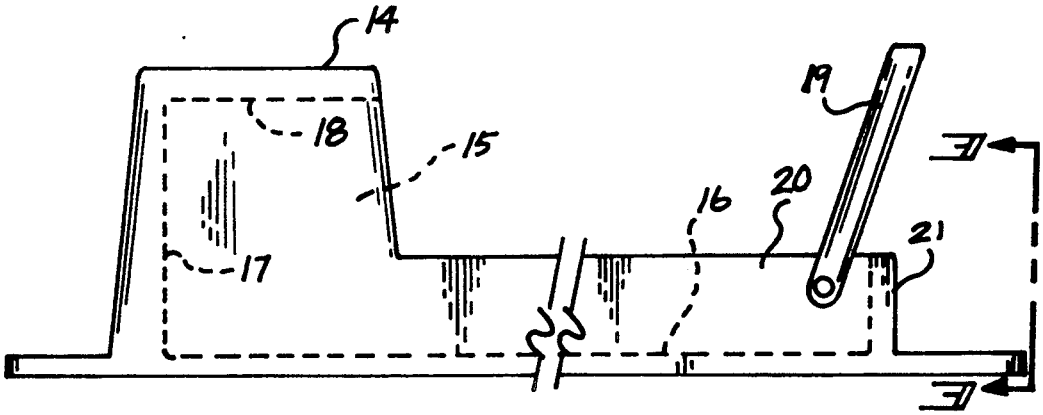
FIG. 2 is an orthographic side view of the skate support member utilized by the instant invention.
Figure 3:
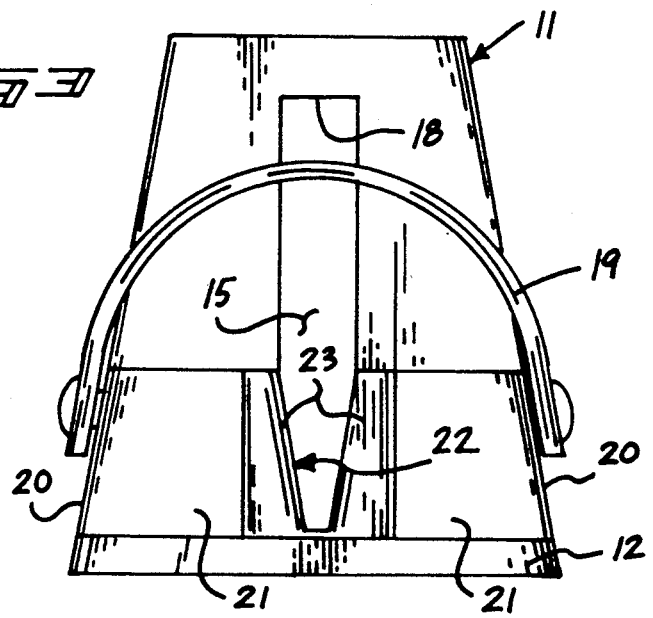
FIG. 3 is an orthographic view, taken along the lines 3—3 of FIG. 2 in the direction indicated by the arrows.
Figure 4:
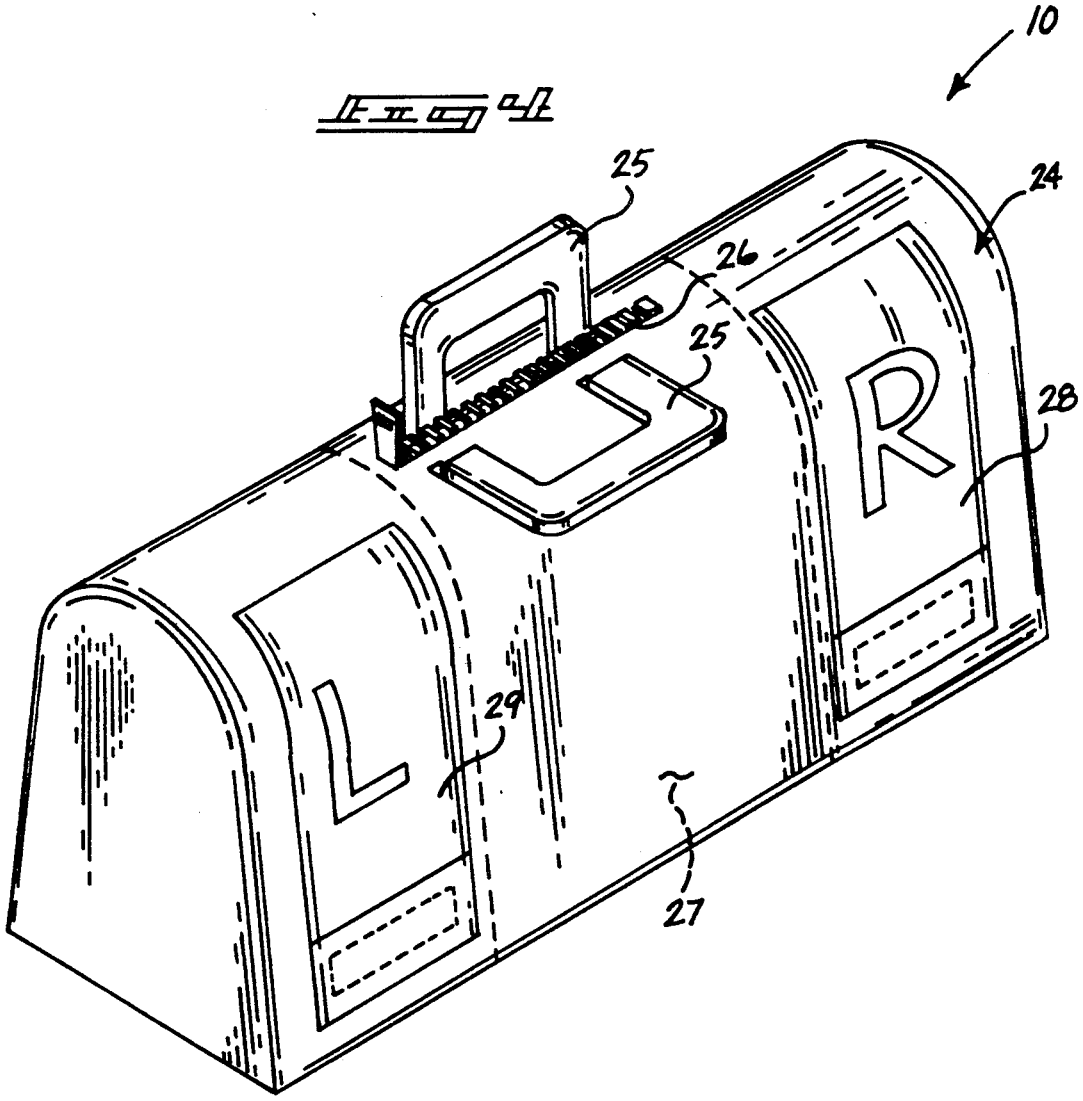
FIG. 4 is an isometric illustration of the instant invention.

With reference now to the drawings, and in particular to FIGS. 1 to 10 thereof, a new and improved ice skate support and sharpening apparatus embodying the principles and concepts of the present invention and generally designated by the reference numeral 10 will be described.

More specifically, the ice skate support and sharpening apparatus 10 of the instant invention essentially comprises a support bag 24 (see FIGS. 4, 7, 8, and 9) mounting a plurality of skate support members 11 orthogonally relative to the respective first and second side walls 33 and 34 of the support bag. Support member 11 includes a base plate for mounting to a floor of the bag 24 defined by spaced mounting apertures 13 orthogonally directed through the base plate, with a forward housing 14 including a cavity socket 15 positioned over a forward portion of a "V" shaped groove 16. The cavity socket 15 includes a cavity abutment wall 17 orthogonally oriented relative to the longitudinal alignment of the "V" shaped groove, with a cavity roof 18 positioned above the "V" shaped groove 16. The "V" shaped groove extends into the cavity socket 15 and longitudinally beyond the cavity socket 15 defined by groove containing side walls 20 originating from groove containing rear walls 21 orthogonally oriented relative to the side walls 20. A "V" shaped entrance opening 22 includes entrance sharpening stones 23 formed at the entrance opening 22 extending into the "V" shaped groove 16. Upon projection of an ice skate blade into the "V" shaped groove 16, sharpening is effected by the directing of the ice skate blade within the "V" shaped entrance opening defined by the "V" shaped sharpening stone structure 23.

As noted, the support bag 24 includes a plurality of ice skate receiving cavities 30 orthogonally directed through the bag first side wall 33 mounting an ice skate support member 11 therewithin. A respective right and left cover flap 28 and 29 are directed over the bag first side wall 33 and include cooperating first and second hook and loop fastener strips 31 and 32 respectively, with a first hook and loop fastener strip 31 secured to the bag first side wall 33 below the ice skate receiving cavity 30 and the second hook and loop fastener strip 32 mounted to each flag, with the lower edge of the flap cooperative with the first hook and loop fastener strip 31. A zipper 26 is positioned medially in the bag between the spaced cavities 30, with a plurality of handle members 25 defining a handle pair. The zipper 26 provides access to an associated central bag cavity 27 for storage of various components therewithin.

The bag second side wall 34 includes a plurality of spaced support loops 35 that are coaxially aligned mounting an "L" shaped hockey stick 36 therewithin.

Figure 9:
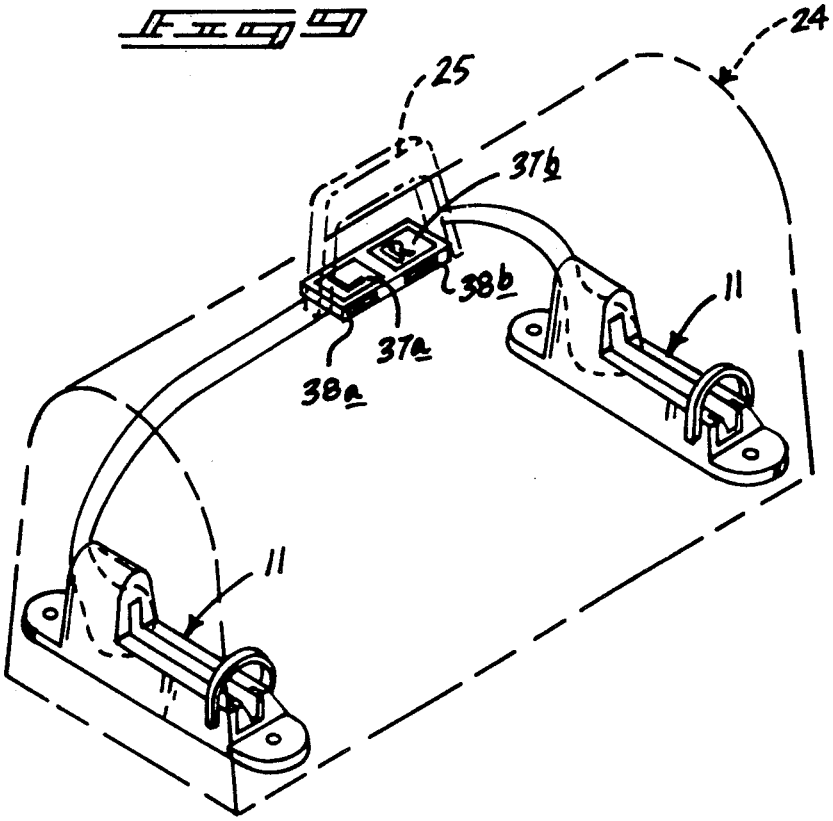
FIG. 9 is a diagrammatic illustration of the modified apparatus as utilized by the instant invention.
Figure 10:
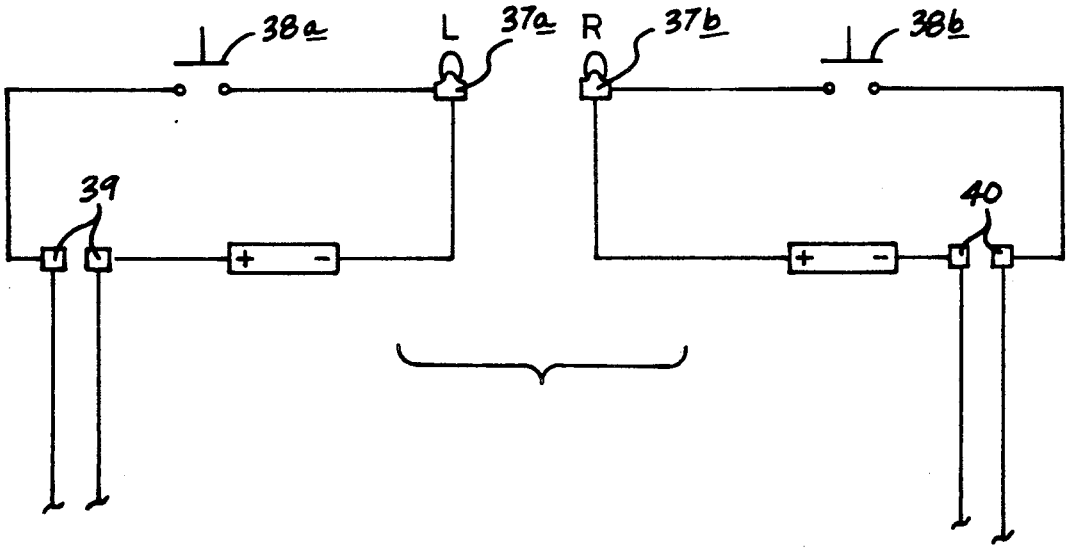
FIG. 10 is a diagrammatic illustration of the electrical circuitry utilized by the invention as set forth in FIG. 9.

FIGS. 9 and 10 illustrate the use of an indicator plate 37 mounted to the exterior surface of the support bag 34, including a respective right and left indicator illumination bulb **37*a* and 37*b* respectively operative through respective right and left switch 38*a* and 38*b*, wherein first and second electrical contact pairs 39 and 40 are respectively directed through the respective left and right support members 11 mounted within the respective left and right cavities behind the respective left and right flaps 29 and 28 respectively. The contact pairs are positioned within the groove on opposed sides thereof to effect electrical communication between an associated ice skate blade to effect illumination of the respective right and left indicator bulbs 37*a* and 37*b***.

Figure 5:
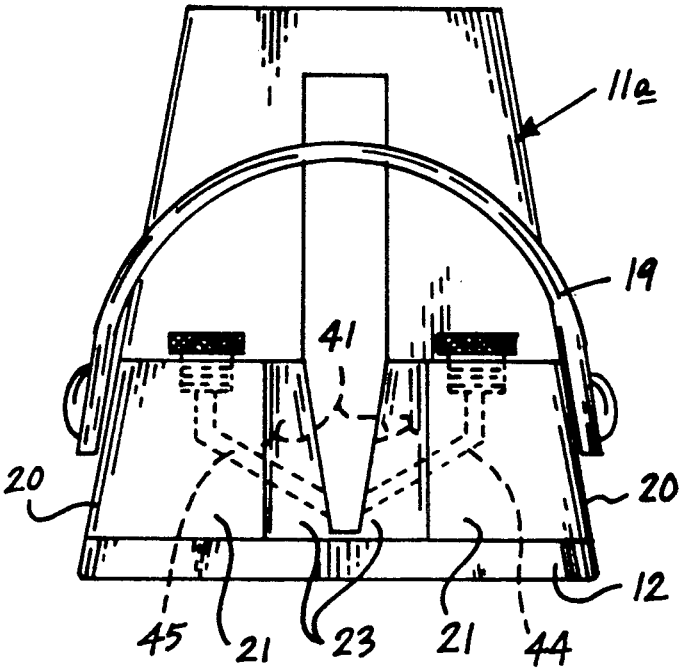
FIG. 5 is an orthographic end view, taken in elevation, of a modified skate support member utilized by the instant invention.
Figure 6:
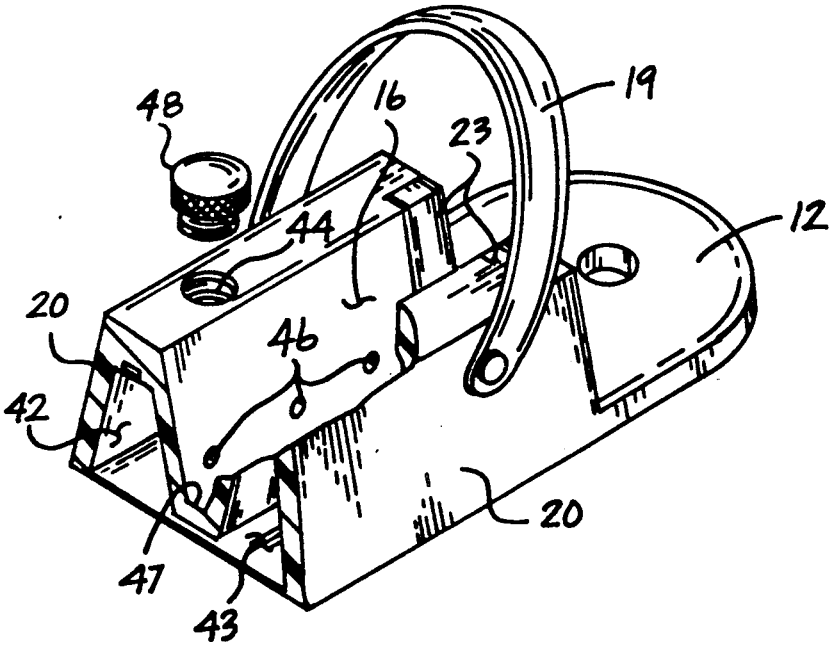
FIG. 6 is an isometric view, partially in section, illustrating the modified skate support member and its reservoir construction.
Figure 7:
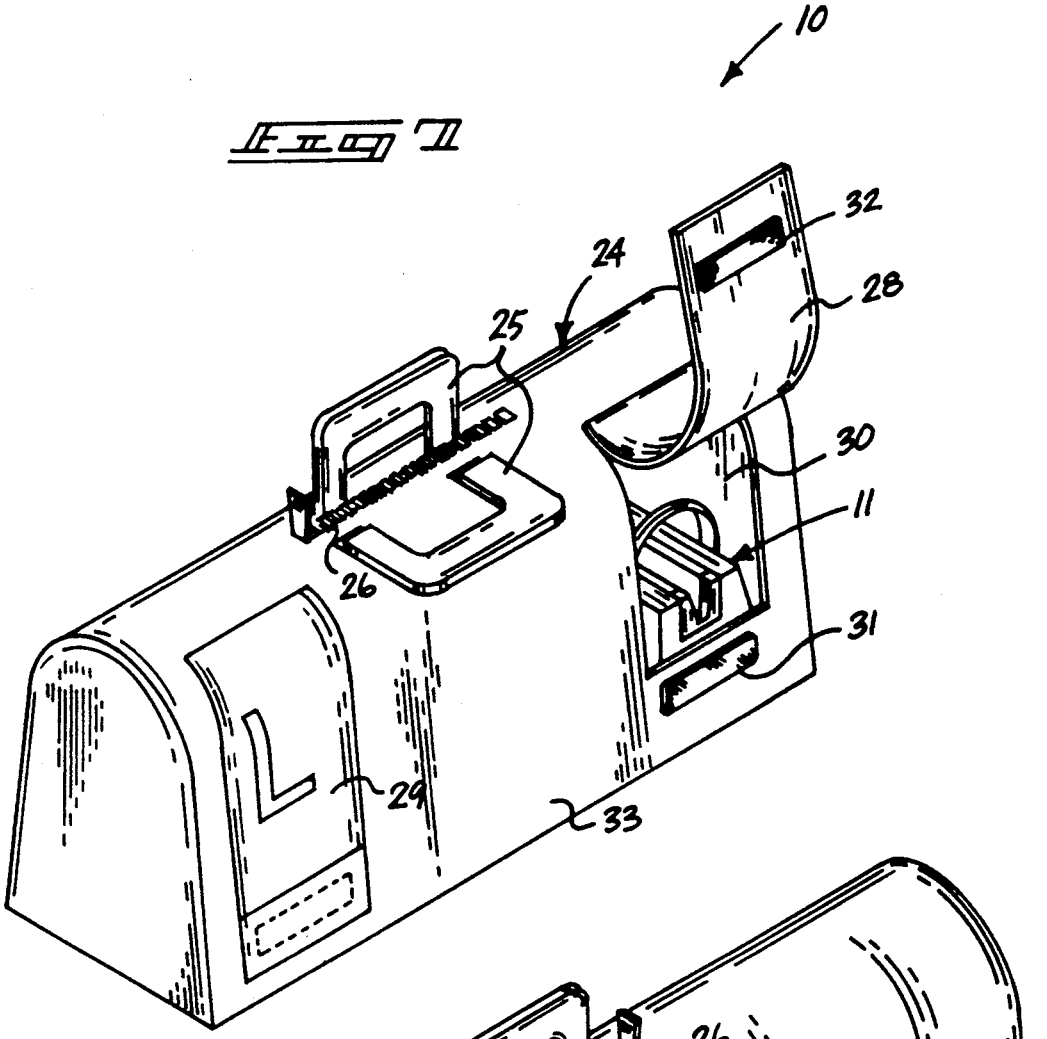
FIG. 7 is an isometric illustration of the instant invention illustrating cavity flap exposing an ice skate receiving cavity.
Figure 8:
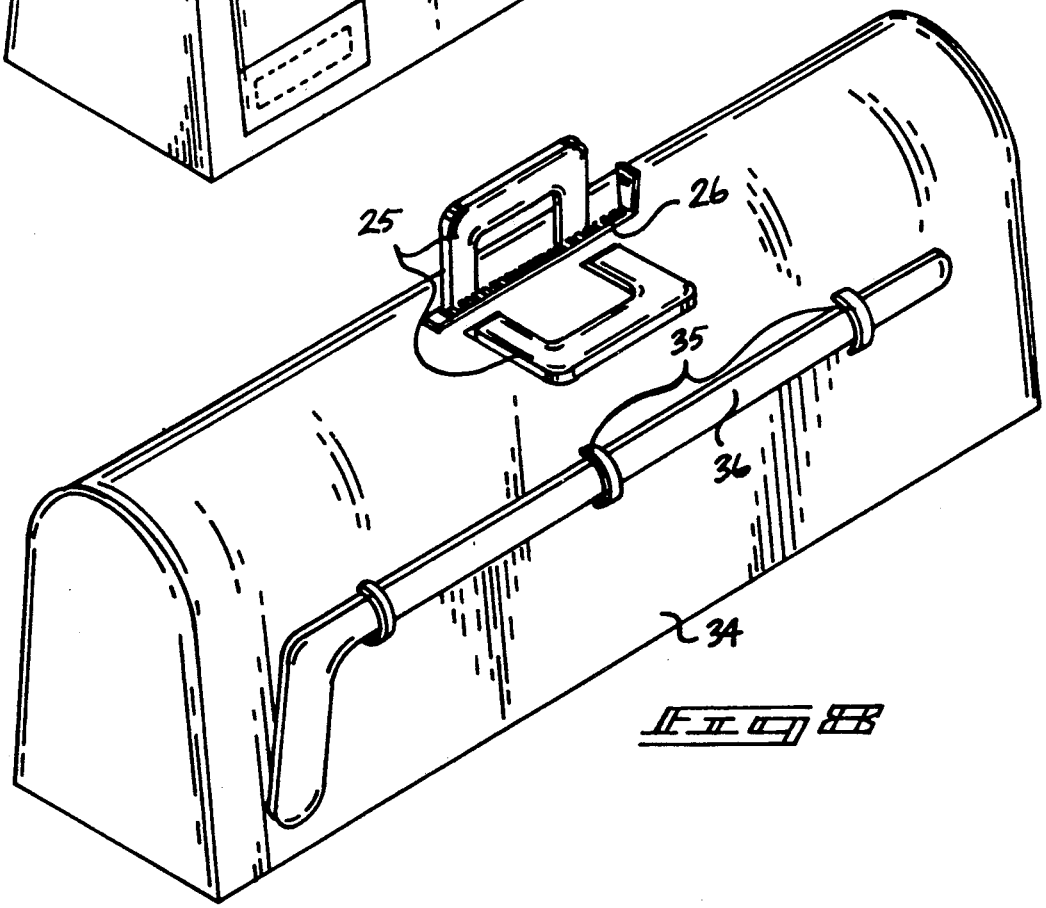
FIG. 8 is an isometric illustration of the instant invention illustrating a second side of the bag member and the associated support loops and hockey stick contained therewithin.

A modified skate support member **11*a* is illustrated for use by the organization in FIGS. 5 and 6, wherein a first and second fluid reservoir 42 and 43 are positioned within the support member 11*a* between the grooves 16 and the opposed side walls 20. Access to each fluid reservoir is through respective first and second fill conduits 44, including fill plugs 48. The reservoirs are filled with a lubricant fluid for coating of the ice skate blade when directed into the "V" shaped groove, wherein each of the fluid reservoirs 42 and 43 direct fluid into the "V" shaped groove through respective fluid ports 46 positioned in communication with the "V" shaped groove adjacent the groove floor 47**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An ice skate support and sharpening apparatus, comprising in combination, a transport bag, the transport bag including a floor and a first side wall and a second side wall, the first side wall and second side wall converging into a top wall, and the top wall including a central zipper, the central zipper including a forward edge and a rear edge, with a central cavity positioned below the zipper within the transport bag, and the first side wall including a right cover flap and lift cover flap, the right cover flap and left cover flap pivotally mounted to the first side wall at opposed sides of the central bag cavity, and the transport bag including an ice skate receiving cavity positioned within the bag rearwardly of each flap, and each cavity including a skate support member mounted within the ice skate receiving cavity, wherein each skate support member is mounted to the bag floor.

2. An apparatus as set forth in claim 1 wherein each skate support member includes spaced side walls defining a "V" shaped groove therebetween, the spaced side walls including a rear wall defining a "V" shaped entrance opening, the "V" shaped entrance opening including a "V" shaped sharpening stone member mounted within the "V" shaped entrance opening and within the "V" shaped groove, and each "V" shaped groove including a forward housing defining a cavity socket overlying a forward portion of the "V" shaped groove, the cavity socket including a cavity abutment wall orthogonally oriented relative to the "V" shaped groove, and a cavity roof positioned over the "V" shaped groove for securing an ice skate member therewithin, and the side walls include a pivotally mounted heel support strap pivotally mounted to the side walls of each skate support member for securement of a heel portion of an ice skate member.

3. An apparatus as set forth in claim 2 wherein each flap includes a first hook and loop fastener strip, and the first side wall includes a second hook and loop fastener strip cooperative with the first hook and loop fastener strip for securement of each flap relative to the first side wall.

4. An apparatus as set forth in claim 3 wherein the second side wall includes a plurality of coaxially aligned and spaced loops, and an "L" shaped hockey stick contained within the loops.

5. An appartus as set forth in claim 4 wherein the skate support member includes a first and second fluid reservoir positioned adjacent each respective side wall of each support member, wherein each fluid reservoir includes a plurality of fluid ports directed into the "V" shaped groove adjacent the groove floor, and a fill conduit in communication with each fluid reservoir formed within the skate support member, and a fill plug selectively securable to each fill conduit for permitting selective filling of each reservoir.

6. An apparatus as set forth in claim 5 including an indicator plate mounted to the transport bag, the indicator plate including a right indicator bulb and a left indicator bulb, each indicator bulb including a plurality of electrical communication lines directed to each "V" shaped groove of each skate support member, and each "V" shaped groove including an electrical contact pair, with each electrical contact pair in electrical communication with each electrical communication line, with each contact pair positioned on opposed sides of each "V" shaped groove for effecting completion of electrical circuit associated with each indicator bulb.

* * * * *